United States Patent [19]

Chlebda

[11] 4,036,418

[45] July 19, 1977

[54] SPOOL HOLDER

[76] Inventor: Kazimirz Chlebda, 425 Margaret Ave., Baltimore, Md. 21221

[21] Appl. No.: 653,244

[22] Filed: Jan. 28, 1976

[51] Int. Cl.[2] ..... A47G 23/00

[52] U.S. Cl. ..... 224/48 F; 211/59.1; 221/76; 242/134; 242/139

[58] Field of Search ..... 224/48 F, 48 R; 211/59; D6/20, 23, 24, 25; 242/134, 139; 223/106, 107; 221/120, 76

[56] References Cited

U.S. PATENT DOCUMENTS

| | | | |
|---|---|---|---|
| 410,175 | 9/1889 | McAlister | 211/59 |
| 829,198 | 8/1906 | Eschholz | 223/107 |
| 1,249,706 | 12/1917 | Zimmerman | 223/107 X |
| 1,367,685 | 2/1921 | Cohn | 242/139 |
| 3,197,096 | 7/1965 | Marcocchio | 223/107 |
| 3,464,648 | 9/1969 | Fuhriman | 242/139 |
| D. 179,209 | 11/1956 | Miller | D6/23 |
| D. 204,718 | 5/1966 | Marchetti | D6/23 |

*Primary Examiner*—L. J. Paperner
*Assistant Examiner*—Donald W. Underwood
*Attorney, Agent, or Firm*—J. Wesley Everett

[57] ABSTRACT

The spool holder is provided with a plurality of circular discs of different diameters in which each disc is provided with one or more rows of pins, each pin being of such diameter and length as to extend loosely into the hole formed in a standard type spool. The pins are positioned on the upper surface of each of the discs, and the discs are supported one above the other in a single vertical axis arranged in order of their diameters, the smallest diameter disc being at the top, the disc immediately above a disc carrying more than one row of spool-carrying pins being provided with a single recess extending inwardly from the outer edge of the disc to a point substantially over the pins on the inner row adjacent the outer row of pins.

2 Claims, 6 Drawing Figures

SPOOL HOLDER

The invention relates to an improvement in a spool holder which may be supported on a table or upon a portable stand.

The primary object of the invention is to provide a minimum-sized spool holder for a large number of spools.

Another object of the invention is to provide a structure in which a plurality of closely assembled spool carrying discs are supported one above the other having means associated with certain of the discs to provide access to spools carried inwardly from the outer edge of the discs.

While several objects of the invention have been noted, other objects, uses and advantages will become more apparent as the nature of the invention is more fully disclosed in the following specifications with reference to the accompanying drawings, in which.

Like reference characters are used to designate like and similar parts throughout the several views.

Figure 3:
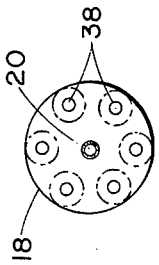
FIG. 3 is a sectional view taken on the line 3—3 of FIG. 2.
Figure 4:
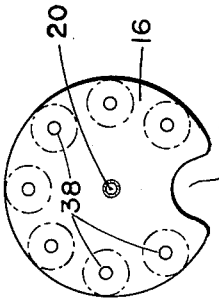
FIG. 4 is a sectional view taken on line 4—4 of FIG. 2.
Figure 5:
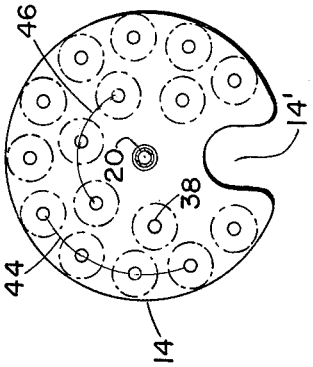
FIG. 5 is a sectional view taken along line 5—5 of FIG. 2.
Figure 6:
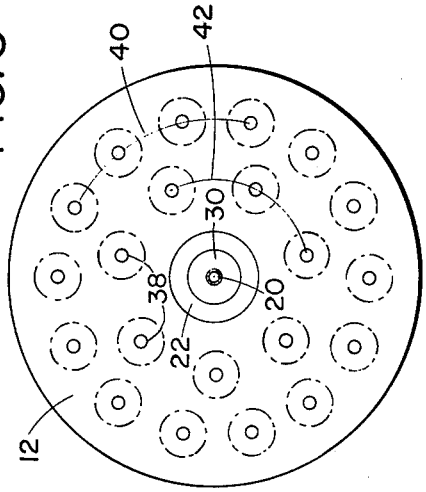
FIG. 6 is a sectional view taken on line 6—6 of FIG. 2.
Figure 2:
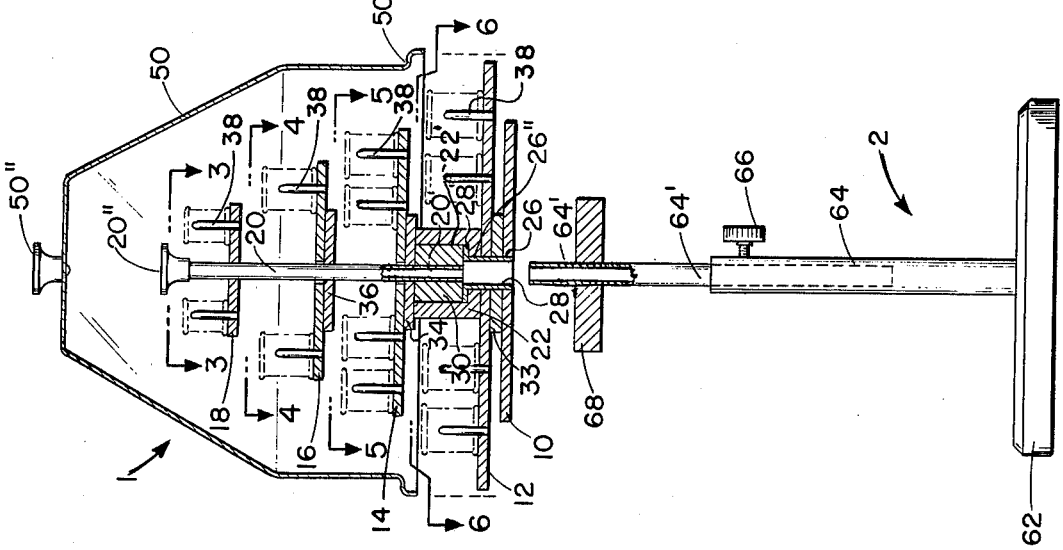
FIG. 2 is a sectional view of the spool holder per se and the stand partly in section and partly in elevation and in position to receive the spool holder assembly.
Figure 1:
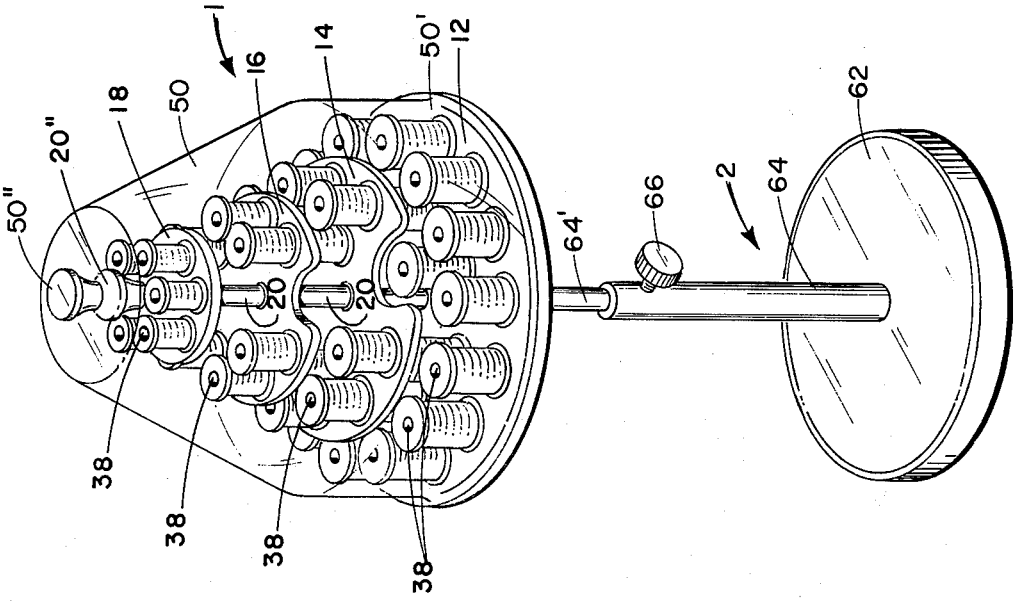
FIG. 1 is a view in perspective of the spool holder showing the manner in which the spools are supported thereon.

The spool holder assembly 1 may be supported either upon a stand 2 as shown in FIGS. 1 and 2, or it may be rested upon a table or other horizontal surfaces.

The spool holder assembly 1 comprises a plurality of closely spaced rotatable discs 12, 14, 16 and 18, which are supported upon a base 10. The lowest disc 12 is provided with a spacer 22 which also acts as a support for the spindle 20 on which the discs 14, 16 and 18 are supported in a plane perpendicular to the disc 12. The end 20' of the spindle 20 is fixed into a holding element 30 supported in a opening 22' formed in the upper side of the spacer 22 by gluing or other suitable means, as shown in FIG. 2.

The spacer 22 is also part of a coupling arrangement between the spool holder assembly 1 and the base 10 wherein all the discs may be manually rotated relative to the base. With reference to the coupling arrangement, the lower side of the spacer 22 and the disc 12 are provided with an aperture 26 extending through the centers thereof and leading to the inner end of the opening 22' which is of greater diameter than the aperture 26 to provide a shoulder at the lower end of the opening 22' (See FIG. 2).

Extending through the aperture 26 is a connector tube-28. The tube 28 is provided with an outwardly turned flange 28' adapted to engage the shoulder formed at the bottom of the opening 22'. That portion of the aperture 26 extending through the spacer 22 and the disc 12 is of such diameter as to allow rotation between these members and the connector tube-like member 28.

A plug-like member 30 is secured within the opening 22' of the member 22 upwardly from the shoulder formed at the bottom of recess 22' at a distance at least equal to the thickness of the outwardly turned flange 28'. The member 30 may bae fixed in position by any suitable means including gluing. This arrangement will allow all of the spool-supporting discs to be manually rotated relative to the base.

The member 30 is provided with a central aperture extending therethrough into which is secured the lower end 20' of the spindle 20. The member 30 is in slideable contact with the outwardly extended bead 28' of the tube 28 and rotatably fitted in the spacer 22 and the disc 12 in order to allow the spool holder assembly 1 to rotate about the said tube.

Extending below the lower disc 12 is a spacer 33 on which the spool holder assembly will rotate. The spacer 33 is preferably fixed to the base member 10 by gluing or other appropriate means. The lower end of the tube 28 is preferably affixed to both the spacer 33 and the base 10 but at least to the base 10. The lower disc 12 is of greater diameter than the remaining discs supported on the spindle 20. Adjacent the bottom of the disc 14 and affixed to the spindle 20 is a spacer element 34 on which the disc 14 rests and is freely rotatable about the spindle 20.

Spaced upwardly from the spacer element 34 is a second spacer element 36 fixed to the spindle 20 on which the disc 16 rests and which is also freely rotatable about the spindle 20, and fixed to the spindle 20 above the spacer 36 is the disc 18. However, this disc 18 may also be supported upon a spacer (not shown) similar to those shown for discs 14 and 16 if preferred.

On two of the discs 12 and 14 there are two circular rows of pins. On disc 12 there is an outer row 40 and an inner row 42. On disc 14 there is an outer row 44 and an inner row 46. The object of the inner rows of pins is, of course, for increasing the spool capacity of the spool holder.

In order to remove the spools from the inner row of pins on disc 12 there is provided in the edge of disc 14 a single recess 14' and in order to remove the spools from the inner row of the pins on disc 14 there is a single recess 16' in the disc 16. All of the discs above the lowest disc 12 are supported on the spindle 20.

In order to keep the spools and their contents clean, there is provided a cover 50 which is provided with a step 50' adapted to rest on the outer edge of the lower disc 12, as shown best in FIGS. 1 and 2. For handling the removable cover 50 there is provided a knob 50'' at the top thereof.

When the cover 50 is removed there is provided a knob 20'' fixed to the upper end of the spindle 20 for lifting and carrying the spool holder assembly from place to place.

As mentioned hereinbefore, the spool holder assembly may be supported on a stand 2, as shown in FIGS. 1 and 2. The stand 2 is provided with a base 62. A hollow stem 64, one end of which is fixed perpendicularly to the base and an adjustable member 64' adapted to slide within the stem 64 whose position may be adjusted relative to the hollow stem 64 and held in adjusted position by the thumb screw 66. At the upper end of the member 64' is a member 68 for receiving the base member 10 of the spool holder assembly. A portion 64'' at the upper end of the member 64' is adapted to extend into the lower end of the tube 28 for holding the spool holder in a fixed upright position.

With the present construction an additional inner row of pins 38 for holding the spools may be carried on the lower disc 12 and the adjacent disc 14. The discs 14 and 16 are provided with single recesses 14' and 16' respectively.

With these recesses the spools carried by the inner row of pins positioned on discs 12 and 14 may be easily removed through the respective recesses which makes for a more compact spool holder of the rotatable disc type, the present holder having the capacity for carrying fifty spools.

In operation, assuming that all the pins are provided with a spool, the spool holding discs are rotatably mounted on the base in order that the user may observe and select the desired spool. Should the spool selected be on one of the pins located on the inner row, the disc immediately above the disc carrying the selected spool is rotated on the spindle 20 until the recess is opposite the selected spool where it is easily removed and replaced through the respective recess.

These spool holders may be made in different sizes; however, a fifty spool capacity holder is believed sufficient for the average sewing operation.

While a specific construction has been shown and described, it is not intended as a limitation, as the scope of the invention is best defined in the following appended claims.

I claim:

1. A spool holder comprising in combination:

a. a base adapted to support a plurality of circular horizontal spool supporting discs in spaced relationship, one above the other and above the said base, including a bottom disc rotatably supported on said base and means for supporting at least two independently rotatable discs at different spaced intervals from the bottom disc and from each other and on the same vertical axis as the said bottom disc including a plurality of spool-positioning pins positioned on the supper surface of each disc, b. a spacer positioned adjacent the center of the upper surface of the bottom disc having a central opening extending therethrough including a shoulder adjacent the bottom of the spacer and adjacent the upper surface of the bottom disc, c. a coupling for connecting the base with the said spacer having an outwardly turned flange about the upper portion thereof for engaging the shoulder of the spacer for rotatably supporting the spacer and the bottom disc on the said base and means for fixing the said coupling to at least the base member, d. a plug element fixed within the upper portion of the said spacer having a central opening therein, e. the means for supporting the independently rotatable discs being in the form of a perpendicular spindle, said spindle being affixed to said plug element, f. separately spaced spacers affixed to the spindle for supporting each of the two upper discs centrally and at spaced intervals on said spindle, each upper disc having a central opening extending therethrough to permit independent rotation of each upper disc around the spindle.

2. In a spool holder as claimed in claim 1 wherein the connector is provided with an aperture adapted to receive the upper end of a supporting standard for supporting the said spool holder.

* * * * *